United States Patent [19]

Klein et al.

[11] Patent Number: 4,853,591

[45] Date of Patent: Aug. 1, 1989

[54] MULTIPLE-TUBE COMPACT LOW-PRESSURE DISCHARGE FLUORESCENT LAMP

[75] Inventors: Lutz Klein; Ernst Panofski, both of Augsburg; Roland Kastl, Unterhaching, all of Fed. Rep. of Germany

[73] Assignee: Patent Treuhand Gesellschaft fur elektrische Gluhlampen mbH, Munich, Fed. Rep. of Germany

[21] Appl. No.: 139,626

[22] Filed: Dec. 29, 1987

Related U.S. Application Data

[63] Continuation-in-part of Ser. No. 669,804, Nov. 9, 1984, abandoned.

[30] Foreign Application Priority Data

Nov. 25, 1983 [DE] Fed. Rep. of Germany ..... 8333920
Dec. 8, 1987 [DE] Fed. Rep. of Germany ..... 3741566

[51] Int. Cl.[4] ..... H01J 61/32; H01J 61/54

[52] U.S. Cl. ..... 313/493; 313/595; 313/634; 313/600; 315/60

[58] Field of Search ..... 313/491, 492, 493, 595, 313/601, 623, 634, 600; 315/60

[56] References Cited

U.S. PATENT DOCUMENTS

| | | | |
|---|---|---|---|
| 4,481,442 | 11/1984 | Albrecht et al. | 313/493 |
| 4,524,301 | 6/1985 | Cohen et al. | 313/493 |
| 4,530,710 | 7/1985 | Dullea et al. | 313/493 X |
| 4,539,510 | 9/1985 | Bouchard | 313/493 |
| 4,611,148 | 9/1986 | Kato et al. | 313/595 |

FOREIGN PATENT DOCUMENTS 58-112237 7/1983 Japan .

*Primary Examiner*—Kenneth Wieder
*Attorney, Agent, or Firm*—Frishauf, Holtz, Goodman & Woodward

[57] ABSTRACT

At least two discharge units (2, 3; 14, 15, 16; 21, 22, 23, 27, 28, 29) are located adjacent each other, each of the discharge units preferably including a unitary U-shaped tube having two longitudinal leg portions (*2a, 2b; 3a, 3b*) extending parallel to each other, and a cross portion (4, 5) connecting the leg portions at the base of the U. The free ends of the U are pinch-sealed and air-tight, and the two discharge units are so positioned relative to each other that the longitudinal leg portions extend parallel to each other, selectively, in a single plane, in parallel planes, or angled with respect to each other; the cross elements are located at adjacent end portions of the respective units. One filament-carrying electrode is sealed into one free end of one leg of one U-shaped tube of one unit, and another filament-carrying electrode is sealed into a free end of one leg of another unit; the units are cross-connected to provide a continuous discharge path, the cross connection being effected adjacent pinch-sealed ends of those legs of the U-shaped tubes which do not have filament-carrying electrodes sealed therein. To facilitate lamp starting, an auxiliary electrode (116) is pinch-sealed adjacent the cross connection, and coupled by an impedance (117) to the "hot" filament-carrying electrode.

26 Claims, 7 Drawing Sheets

MULTIPLE-TUBE COMPACT LOW-PRESSURE DISCHARGE FLUORESCENT LAMP

This is a continuation-in-part of U.S. Ser. No. 669,804, filed Nov. 9, 1984, by co-inventors Klein and Panofsky and now abandoned.

Reference to related patent, assigned to the assignee of the present application, the disclosure of which is hereby incorporated by reference:

U.S. Pat. No. 4,481,442, Albrecht et al.

U.S. Pat. No. 4,647,817, Fahnrich et al.

U.S. Ser. No. 048,005, filed May 8, 1987, now U.S. Pat. No. 4,775,822, Statnic et al.

The present invention relates to a compact low-pressure discharge fluorescent lamp, and more particularly to a fluorescent discharge lamp of the type which has multiple U-tubes, so that the light output of such a discharge lamp is enhanced over that having only a single U-tube structure.

BACKGROUND

It has previously been proposed to construct fluorescent lamps in form of a U-tube, into which electrodes are secured at the free ends of the legs of the U, and then, after applying a fluorescent coating to the inside of the tube, evacuation and filling of the tube with a suitable fill of noble gas and mercury, sealing the tube by a pinch or press seal. A lamp of this type is described in the referenced U.S. Pat. No. 4,481,442, Albrecht et al, assigned to the assignee of the present application, the disclosure of which is hereby incorporated by reference. In this lamp, the base of the U has a very specific shape in order to provide cooling zones which control the mercury vapor pressure within the lamp.

In order to increase light output from mercury vapor discharge fluorescent lamps, it has also been proposed to couple a plurality of parallel straight lamps or lamp sections by coupling connections to form a single discharge vessel of the respective straight elements, see for example U.S. Pat. Nos. 3,501,662, Plagge, 4,374,340, Bouwknegt et al, and 4,530,710, Dullea et al. In order to provide for "cold spots" or cooling zones which control vapor pressure in the discharge lamp, the coupling connections have been placed at specific and predetermined distances from the respective ends of the straight tubular portions, as described in detail in U.S. Pat. No. 4,374,340.

Straight tubular portions, by suitable coupling, thus can be assembled together to form discharge vessels of various shapes, such as H-shaped discharge vessels, in which the cross bar connection of the H can be fairly close to an upper end portion of the vessels to enhance light output. Multiple arrangements are possible, that is, the cross connections between multiple adjacent tubes, such as three or four, can be placed, staggered, closer to the upper and lower ends of the respective straight tubes. Forming such coupling connections—of which always one less than the number of straight tube units are required—is comparatively expensive and requires precise adjustment of complex apparatus. The elements are cross-connected by melting together projecting collars of adjacent tubes. This requires highly precise positioning of the tubes with respect to each other so that the overall dimensions will be accurately maintained to permit the parallel tubes to, later on, fit into a base. The end portions of the cross connections experience a drop-off of light and thus do not present, to the viewer, a uniformly U-shaped illuminated structure but, rather, a plurality of longitudinal light bars of varying light intensity which, for some applications, is esthetically undesirable.

It has also been proposed to construct a discharge vessel by bending a long tube a number of times into respective U-shapes. This, however, require bending over a fairly large radius. Due to the wide radius it is possible to coat the inside of the tube with fluorescent material before bending.

The referenced Albrecht et al U.S. Pat. No. 4,481,442 describes a fluorescent lamp having a unitary discharge vessel in which the diameter of the discharge vessel in the region of the U-bend is larger than in the central portion of the connecting or base region of the U of the bent structure. This arrangement provides for the necessary cold spots to obtain optimum mercury vapor pressure, without formation of dark zones. Discharge vessels bent in accordance with this structure can be uniformly coated with fluorescent material only after bending. No difficulties are experienced in such a discharge vessel if a single U-shaped structure is provided; if, however, a multiple U-bent structure, with connected portions and the cross elements of the U at the opposite ends of the legs, is to be formed, complex and expensive procedures are necessary to provide for essentially uniform coating of the interior of the tube with fluorescent powder after formation of the tube structure.

It has been found that starting of a fluorescent lamp formed of a plurality of U-shaped elements may cause problems unless a more complex starting circuitry and ballast equipment is used than customary with only a two-leg U structure. This is true even for lamps operated directly from a 220 V alternating current supply; when operated with lower voltage power supply, for example 110 V nominal, obtaining sufficient ignition voltage becomes difficult. The temperature range of operation of accessory equipment, likewise, becomes more critical since the lamp voltage required for ignition or firing increases if temperatures deviate substantially from "room temperature" in both the direction towards high temperature as well as towards low temperature.

THE INVENTION

It is an object to provide a compact low-pressure discharge lamp, of the fluorescent lamp type, in which the discharge vessel extends in more than two parallel straight portions, and which can be readily assembled by combination of readily made subassembly elements, which, additionally, can be easily coated with fluorescent coating material, while permitting maintenance of dimensions for placement of the assembly into prefabricated bases in a simple and easily controlled manner, and which can be easily started from power networks of 110 V (nominal).

Briefly, the discharge vessel comprises at least two discharge units, in which each discharge unit is a unitary U-shaped tube having two longitudinal leg portions extending parallel to each other and a cross element or base portion of the U, connecting the leg portions at the base of the U. The free ends of the legs of the U-shaped tube are pinch-sealed and air-tight. The at least two discharge units are located relative to each other with the longitudinal leg portions extending parallel to each other. The cross elements are located at adjacent end portions of the respective units. A filament-carrying electrode is pinch-sealed into one free end portion of the leg of one of the U-shaped tubes, and another filament-carrying electrode is pinch-sealed into one free end portion of another one of the U-shaped tubes. An air-tight communication connection between adjacent discharge units is located between adjacent discharge tubes adjacent the pinch-sealed ends of the legs of the U-shaped tubes which do not have filament-carrying electrodes sealed therein, but are merely pinch-sealed, to form a continuous discharge path between the electrodes.

In accordance with a feature of the invention, auxiliary electrodes are pinch-sealed into one or more of the legs of the U-shaped tubes which do not have filament-carrying electrodes sealed therein. In its simplest manner, a standard electrode mount is pinch-sealed into those legs, in which, however, the filament has been omitted so that merely one or two wire elements extend into the interior of the respective leg of the U-shaped tube. The auxiliary electrode, or electrodes, as the case may be, is then externally connected through an impedance element, which may be a resistor or a capacitor, with one of the two lamp electrodes.

This arrangement has the advantage that an initial discharge path is available between the ignition or auxiliary electrode and one of the filament-carrying, and hence heated electrodes, which is shorter than the path between heated electrodes.

Manufacturing of such a multiple U-tube compact fluorescent lamp is substantially simplified by first making single U-tube elements, with their respective configuration to provide for the appropriate mercury vapor pressure. The number of cross connections becomes less with respect to prior art structures, such as shown, for example, in U.S. Pat. Nos. 3,501,662 and 4,374,340. Less than half of the cross connections need be used. The tubes which are to be assembled are already bent into U-shape—which can be done easily and with great accuracy—so that maintenance of accurate alignment of two U-tubes with respect to each other becomes substantially simpler than a larger number. Setting the assembly in a prefabricated base simplifies the overall manufacture. The bends of the transverse portion at the base of the U, as described in the referenced U.S. Pat. No. 4,481,442, Albrecht et al, provide the necessary cold spots to set the mercury vapor pressure. Since no further cold spots are necessary within the overall discharge vessel, namely the multiple U-tubes which are connected together, it is possible to utilize various types of cross connections, and to locate these cross connections close to the sealed ends of the longitudinal tubular portions, corresponding to the legs of the U, for example close to or joined to the pinch seal. This permits locating any cross connections within a base structure, so that cross connections which are not coated with fluorescent material will be covered by the base itself which, customarily, is made of an opaque plastic. Pinch-sealing the free ends of the tube legs, even those which do not have filament-carrying electrodes placed therein, is a reliable, economical and easily automated closing arrangement.

In accordance with a feature of the invention, the manufacturing process is simplified by using pinch seals or press seals at the ends of all of the longitudinal or leg portions of the U-sections, regardless of whether filament-carrying electrodes, auxiliary electrodes or no electrodes at all are applied.

DRAWINGS

DETAILED DESCRIPTION

Figure 1:
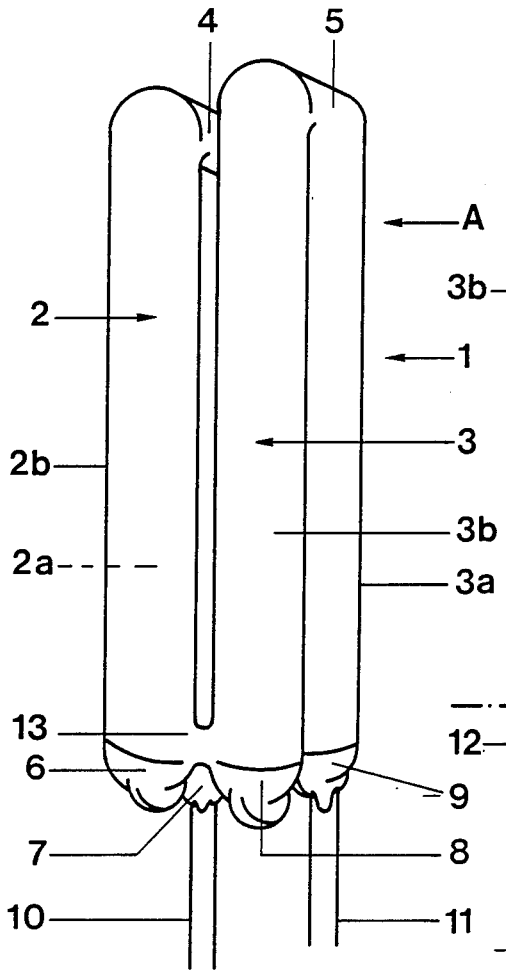
FIG. 1 is a perspective view of a preferred form of a dual U-bent compact fluorescent lamp.
Figure 2:
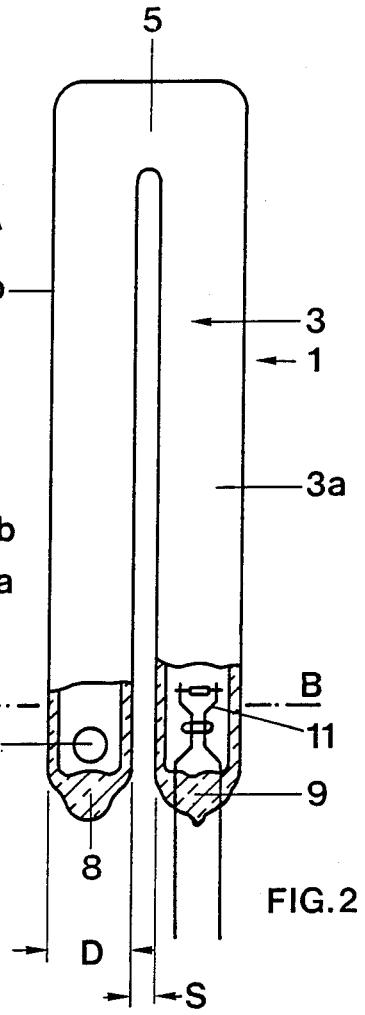
FIG. 2 is a side view of the lamp of FIG. 1, taken in the direction of the arrow A, with the lamp partly broken away.
Figure 3:
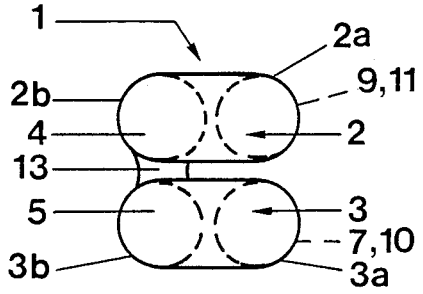
FIG. 3 is a top view of the lamp of FIG. 1 before applying phosphor.

The preferred embodiment of the lamp is shown in FIGS. 1–3, in which a discharge vessel 1 provides a continuous discharge path through two U-bent discharge units 2, 3. The discharge units 2, 3 each are made of a U-bent glass tube. The corners of the U-bends or bases of the discharge units 2, 3, each, are blown out during manufacture, so that the base portions 4, 5 extend essentially perpendicularly to the leg portions *2a, 2b, 3a, 3b* of the respective units 2, 3. Pinch seals 6, 7, 8, 9 seal the ends of the legs of the U; one of the pinch seals 7, 9, in one of the discharge units, has an electrode assembly 10, 11, respectively, sealed therein, as well known in fluorescent lamp manufacture. Each one of the subunits 2, 3 can be made as described in the referenced Albrecht et al U.S. Pat. No. 4,481,442.

Both units 2, 3 are located in alignment behind each other, such that the longitudinal leg portions *2a, 2b, 3a, 3b* are placed in parallel planes; the pinch seals 7, 9 with the filament-equipped electrodes 10, 11 therein are on the same side—see FIG. 1. An opening 12 is formed close to the pinch seal of the longitudinal U-tubes *2b, 3b* which do not carry electrodes, and a cross connection 13 is provided there to connect the two discharge units 2, 3 with each other to form a single interconnected and continuous discharge path. The cross connection 13, which is a glass melt connection, is located close to the pinch seals 6, 8, to connect the two discharge units 2, 3 with each other to form a single intereconnected and continuous discharge path. As can be seen from FIGS. 1, 3 and 8, for example, the connection 13 differs from the U-bend portions 4, 5.

The thus formed fluorescent lamp can be connected to a base, which may have any suitable base end, such as a snap-in connection, a screw connection, an "Edison" base or the like. The upper portion of the base covers the cross connections 13 and, of course, the respective pinch seals 7, 9 carrying the electrodes, as well as the blank pinch seals 6, 8. The upper edge of the base may extend, for example, to the chain-dotted line B. The base has been omitted from FIGS. 1 and 2 for clarity of the drawings.

Typical dimensions for the U-shaped tube are: an outer diameter D of 12 mm; a spacing S between the tubes of about 3 mm; a length of the tubes, from approximately the pinch seal 6, 7, 8, 9 to the upper edge of the cross connection 4, 5 of about 10½ cm. Such a lamp may be operated with a ballast or choke having a power factor of cosine $\phi$ of 0.34, a lamp voltage of 97 V, and a lamp current of 150 mA. The power acceptance of the lamp will be 11.5 W, resulting in the light output of 850 lumens.

For architectural lighting, special lighting, special effects, and various other light applications, the arrangement of FIGS. 1–3 can be varied. Numerous effects can be obtained by relocating the respective discharge units, and connecting more than two discharge units together to form a continuous discharge vessel.

The preferred and simplest embodiment is that of FIGS. 1–3, which is easy to make, easy to connect to a standard base, and highly compact, while providing high light output. More than two discharge units may be connected together.

Figure 4:
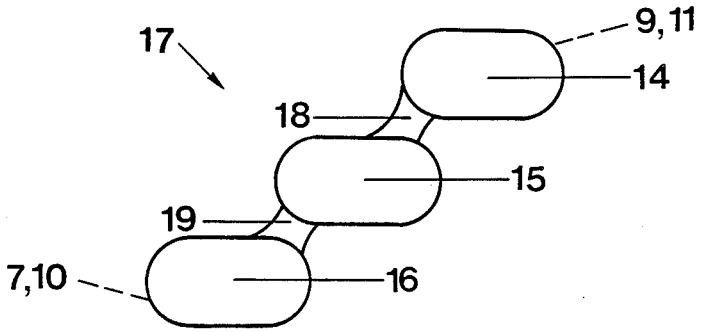
FIG. 4 is a top view of a lamp, without base, showing another arrangement of placement of the U-tubes.

The longitudinal or leg portions of the respective discharge units may be arranged as desired, for example in planes which are parallel with respect to each other, but offset, and not in alignment, as in FIGS. 1–3. FIG. 4 illustrates three units 14, 15, 16 of a discharge vessel 17 which are so located that the longitudinal or leg portions of the respective units 14, 15, 16 are placed in parallel planes which are staggered or offset. Cross connections 18, 19, of which only two are necessary for six longitudinal light-emitting leg portions, connect the respective U-shaped tubes together. FIG. 4 also illustrates, with a broken-line lead line, the placement of the pinch seals which carry the electrodes, which, however, in FIG. 4 are not visible. Thus, the units 14, 16 have a pinch seal 9 with electrodes 11, and a pinch seal 7, with electrodes 10, respectively.

Figure 5:
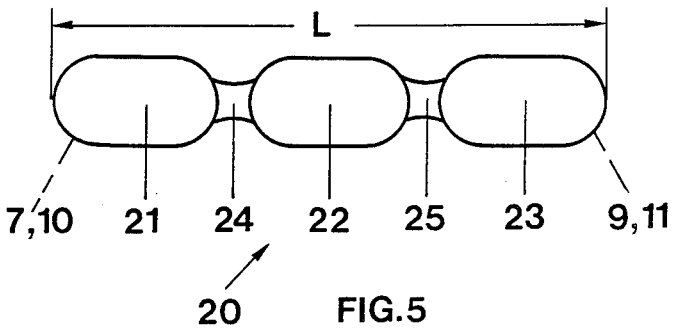
FIG. 5 is a top view showing yet another embodiment, with the lamp—without base—in which the respective U-tubes are located in a common plane.

An essentially flat light source can be obtained as shown in FIG. 5, in which the discharge vessel 20 is assembled of three discharge units 21, 22, 23, located in alignment adjacent each other. All longitudinal or leg portions of the U-tube units 21, 22, 23 are in a single plane. Cross connections 24, 25, of which only two are necessary to connect six longitudinal leg portions, are provided to form a continuous discharge path, which will extend in meander form and will provide an essentially flat or planar light source.

Figure 6:
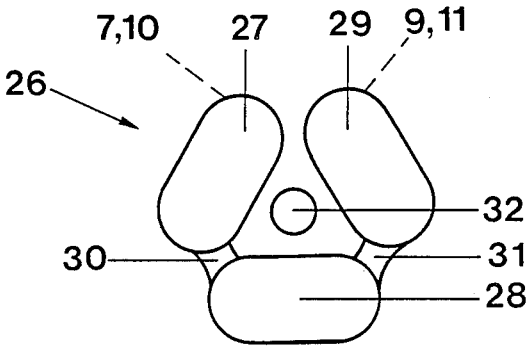
FIG. 6 is a top view of yet another arrangement of a compact lamp, with three U-tubes, without base, in which the longitudinal leg portions are fitted within a theoretical cylinder with polygonal cross section.

Another arrangement, which provides substantial light output, is shown in FIG. 6 in which the discharge units 27, 28, 29, interconnected to form a common discharge vessel 26, are located such that vertical planes through the longitudinal or leg portions of the U-tubes, in top view, form a triangle. Expressed in a different way, a theoretical straight-sided envelope surrounding the longitudinal or leg portions of the U-tube, will form a polygon, in FIG. 6 a triangle. The units 27, 28, 29 are cross-connected by connections 30, 31 to form the entire discharge vessel. If desire, a reflective post or tube 32 can be placed centrally of the entire unit, for example secured to the base, to provide enhanced radiated light output towards the outside of the cylindrical structure, defined by a theoretical surrounding surface of the respective U-tubes, that is, a cylinder with polygonal cross section. FIGS. 5 and 6, further, show the location of the pinch seals which carry the electrodes; since the pinch seals and the electrodes are not visible in the Figures, the reference numerals 7, 10 and 9, 11, respectively, have been connected by broken lead lines.

Various changes and modifications are possible. The versatility of the arrangement permits obtaining decorative effects for use in special archictectural lighting, in light fixtures designed therefor, display lighting and the like. The extremely low power consumption, and hence low heat development of the lamp, with high light output, makes the lamp particularly suitable for many special applications. The flat area illumination provided, for example, by the structure of FIG. 5, can be used to form a single-lamp light panel without diffuser, providing high light output over an extended area. Using the dimensions of the U-tubes given in connection with FIG. 1, the three-unit structure of FIG. 5 will have a longitudinal dimension—perpendicular to the plane of the drawing—of about 10.5 cm and a longitudinal dimension L of just under 9 cm. Subtracting some of the longitudinal dimension for the base, then provides a light source which is approximately square, or only slightly rectangular, effectively in form of a panel of about 9×9 cm.

Various other changes and modifications may be made, and features described herein in connection with any one of the embodiments may be used with any of the others, within the scope of the inventive concept.

Figure 7:
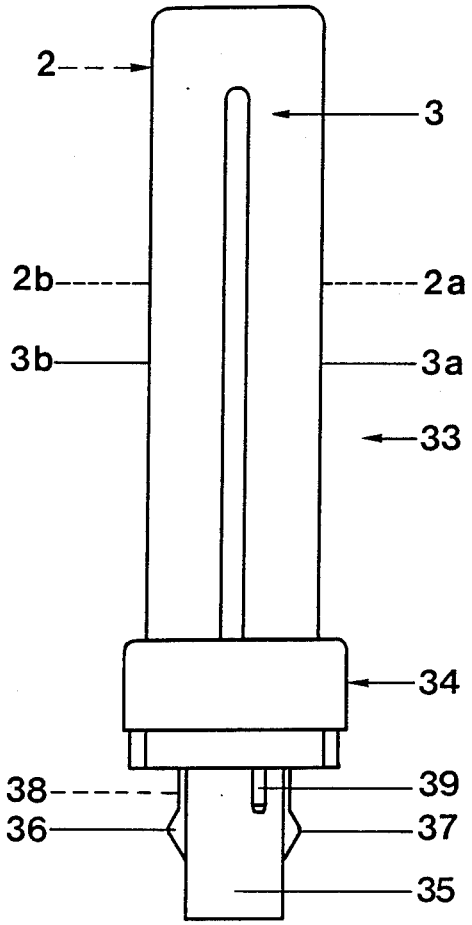
FIG. 7 is a side view of the lamp of FIG. 1, taken in the direction of the arrow A, with a snap-in base.

FIG. 7 illustrates a discharge lamp 33 with a snap-in base 34 of the standard G 24-type. The longitudinal leg portions **2*a*, 2*b*, 3*a*, 3*b* of the two U-shaped discharge units 2, 3 project so far into the base 34 that the cross connection comes to lie within the base 34. The base 34 is of opaque plastic. It has a substantially square cross section and comprises a centering member 35 with holder elements 36, 37 which may serve for reception of a starter. In addition, two diametrically opposite terminal pins 38, 39 are provided on the underside of the base 34**.

The cross connection of the U-tubes may be made by melting together projecting collars on the side walls of the adjacent tube units, as described above.

Figure 8:
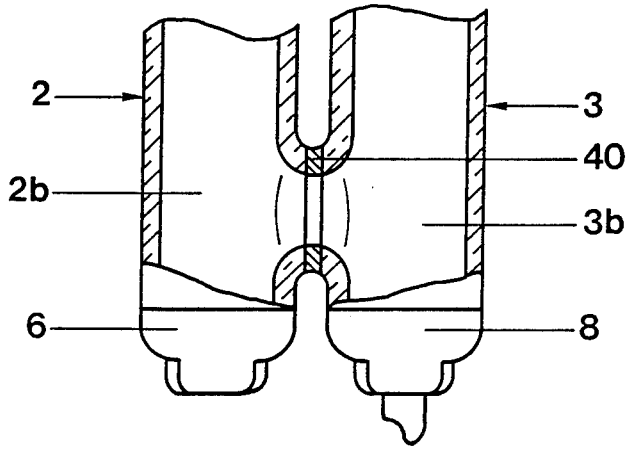
FIG. 8 shows one type of cross connection of the U-tubes of the lamp.
Figure 9:
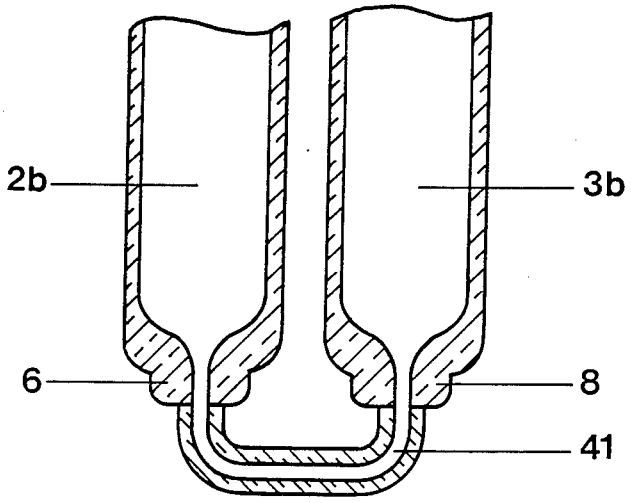
FIG. 9 shows another type of cross connection of the U-tubes of the lamp.

FIGS. 8 and 9 illustrate schematically two further connection possibilities of the U-shaped tubes. The tubes 2, 3 in FIG. 8 are connected in that, first, holes are blown laterally out of the respective longitudinal leg portions **2*b*, 3*b* close to the pinch seals 6, 8, and then a ring 40 of glass solder or of a suitable metal compound is applied around the holes between the longitudinal leg portions 2*b*, 3*b*, and a vacuum-tight seal is obtained by heating. As illustrated in FIG. 9, the leg portions 2*b*, 3*b* may also be connected by a bent glass tube element 41 that is also sealed in the pinch seals 6, 8. A connection as that shown in FIG. 9 has not been tested further. Connection of the discharge units 2, 3** may be made in accordance with any well known glass blowing technique.

In accordance with a feature of the invention, improved ignition or re-ignition without any special or additional accessory equipment requirements can easily be obtained from not only 220 V alternating current networks, but also from nominally 110 V a–c networks. An auxiliary electrode 116 (FIGS. 10, 11, 12 and 13) is pinch-sealed into a pinch seal, for example the pinch seal 8 which does not carry a filament, and introduced into leg portions 3*b*. This electrode may be constructed in the form of a standard electrode assembly, similar to the electrode 10 or 11, omitting, however, the filament 10*a* or 11*a* (see FIGS. 1 to 3). The result will be a pair of unconnected open wires 116*a*, 116*b*, extending into the interior of the respective leg, and pinch or press-sealed therein. The inward extension of the electrode 116 may, and preferably does, extend above the cross connection 13 between the adjacent two legs 3*b* and 2*b*. Alternatively, a special auxiliary electrode structure can be provided in which only a single wire 116 (FIGS. 12, 13) extends internally of the respective leg.

Figure 10:
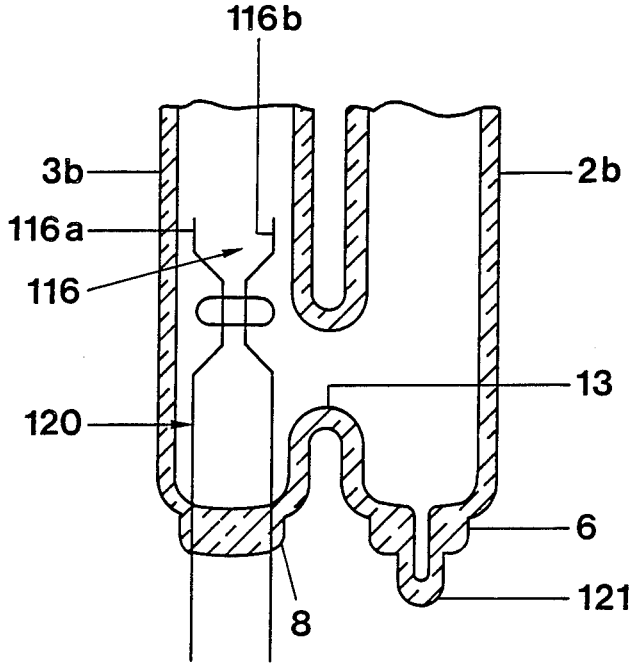
FIG. 10 is a fragmentary cross-sectional view through the end portions of two connected legs, schematically illustrating the placement of pinch seals and an auxiliary electrode.

The filament-carrying electrodes 10, 11 each carry a filament 114, 115. The leg 3*b*, joined by the cross connections 5 to the leg 3*a* of the unit 3, carries the auxiliary electrode 116 which may be a dual unit as shown in FIG. 10, or merely a single wire, pinch-sealed into the pinch seal 8.

The lamp can be operated simply with an ordinary electronic accessory unit.

Figure 11:
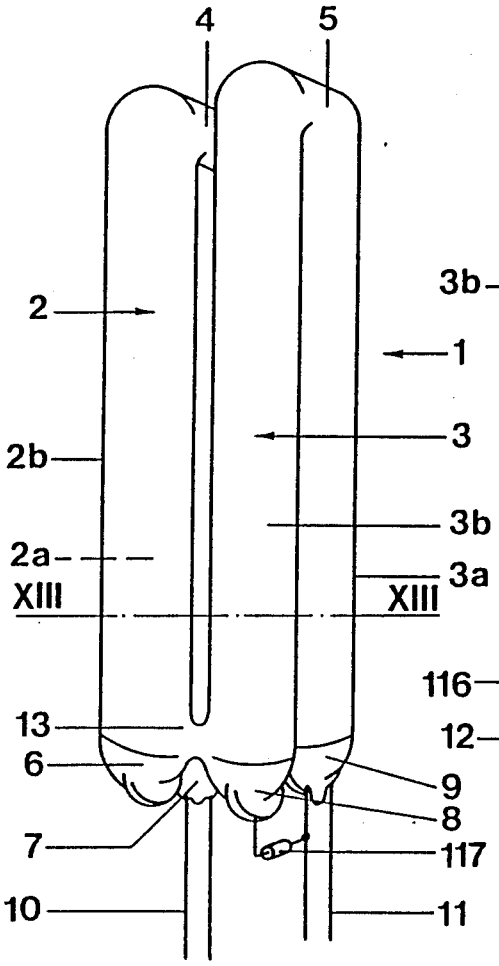
FIG. 11 is a perspective view of a double-U tube compact fluorescent lamp with an auxiliary electrode and a connecting impedance, without a base.
Figure 13:
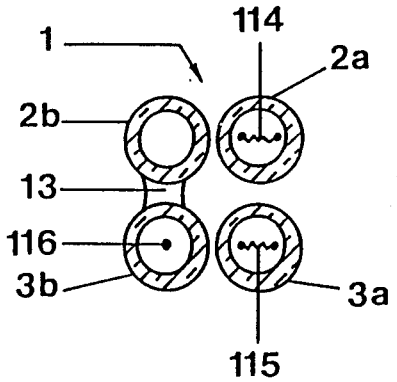
FIG. 13 is a sectional view of the lamp along section line XIII—XIII of FIG. 11.
Figure 14:
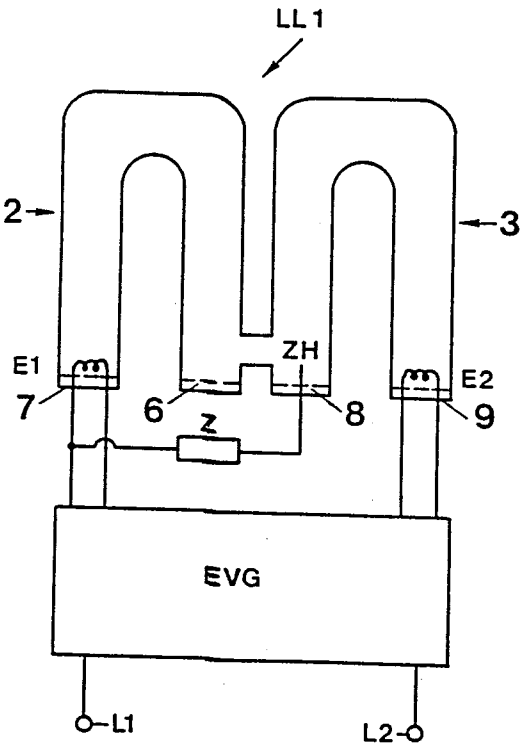
FIG. 14 is a schematic circuit diagram for the operation of two U-connected lamps with an auxiliary electrode.

A dual-U tube lamp shown schematically in FIG. 14 as LL1, and for example of the construction of FIG. 11, is so connected that the first filament-equipped electrode E1 is included in the first pinch or press seal 7. The last pinch or press seal 9 has the second filament-equipped electrode E2 placed therein. The respective filaments of the electrodes E1, E2 are connected to the accessory ballast and starting unit EVG. In addition to the pinch seals 7 and 9 which retain the filament-equipped electrodes E1 and E2, the first pinch seal 8 of the second lamp unit 3 includes an auxiliary electrode ZH which may be in the form of a single electrode wire 116 (FIGS. 12, 13) or in form of a dual wire 116*a*, 116*b* (FIG. 10). In accordance with a feature of the invention, an electrical impedance element Z connects the auxiliary electrode ZH to one of the connecting leads of the filament-containing electrode E1.

The impedance Z, for a compact 20 W fluorescent lamp, that is, containing two nominal 10 W units 2, 3, can be a resistor of for example about 50 kilo ohms; alternatively, it may be replaced by a capacitor of about 100 pF. These value are suitable for line voltages connected between terminals L1, L2 of the auxiliary unit EVG of 60 Hz, 110 V nominal. The peak-to-peak voltage necessary to fire or ignite the lamp can be dropped with this arrangement by about at least 150 V. This is a decrease of ignition voltage by about 15%. The value of the impedance Z should be so dimensioned that the operating characteristics of the lamp are not essentially influenced thereby. In practice, only 0.5% of the lamp current will pass through the impedance Z, which is a loss of less than 0.05 W, and thus can be neglected in ordinary lamp operation.

The lamp LL1 in FIG. 14 is shown in developed position; in actual use, the two units 2 and 3 would be placed parallel to each other as shown in FIG. 11. FIG. 11 illustrates the impedance Z in structural form at 117.

Figure 15:
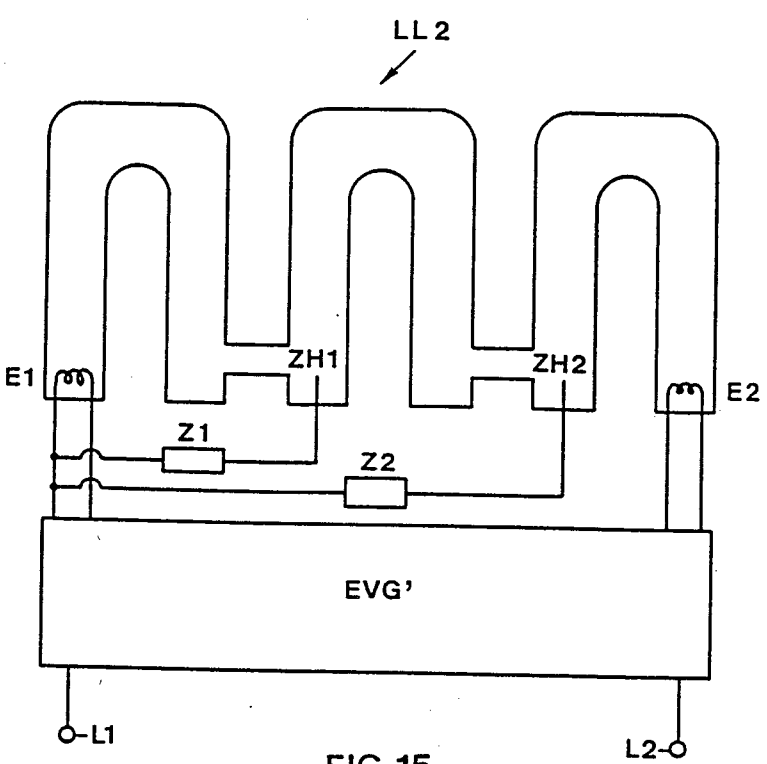
FIG. 15 is a schematic circuit diagram to operate a fluorescent lamp having three U-tubes, and two auxiliary electrodes.

More than two units may be connected together, see for example FIGS. 4, 5, 6. The arrangement of auxiliary electrodes for two connected units is shown, for example, in FIG. 15 which, again, is a developed view. The lamp LL2 with three U-bent tubes is so arranged that the first and second pinch seal of the first and last lamp unit carries the filament-equipped electrodes E1, E2, respectively, which are connected over suitable current supplies with the accessory apparatus EVG'. The first pinch seal of the second lamp unit and the first pinch seal of the third lamp unit each are equipped with an auxiliary electrode ZH1, ZH2, respectively, which may have the form of the electrode 116 or 116*a*, 116*b*; each is connected by a suitable impedance Z1, Z2, for example a resistor, with one of the electrode lead wires from the electrode E1.

In accordance with a feature of the invention, the connection of the respective impedance 117 (FIGS. 11, 12) or Z, Z1, Z2 (FIGS. 14, 15) is to the filament-equipped electrode which is at the "hot" or "live" side, that is, the electrode which normally is not grounded or coupled to a grounded or neutral conductor, i.e. at the "hot" line from unit EVG.

The auxiliary electrode 116; ZH is preferably coupled via the impedance 117, or Z, Z2, respectively, to the "hot" filament-carrying electrode which has the higher potential with respect to ground due to the ballast.

Thus, full high voltage is first applied between the auxiliary electrode and the other, or "cold" or reference filament-carrying electrode. A discharge channel will form between the auxiliary electrode and the "cold" filament-carrying electrode. Voltage between the "hot" filament-carrying electrode and the auxiliary electrode will increase as the discharge to the "cold" electrode from the auxiliary electrode increases, until a discharge will extend over the entire length of the discharge path in the discharge vessel, that is, between the two filament-carrying electrodes. In this condition, the lamp has completely fired, and the phosphor is excited, that is, the lamp has been started and is lit.

Figure 12:
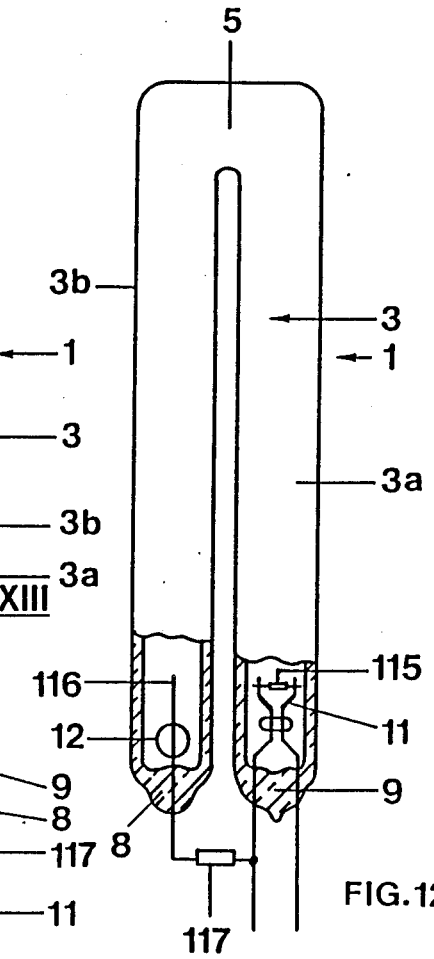
FIG. 12 is a side view of the lamp of FIG. 11.

The auxiliary electrode can be formed by any conductive material, for example a simple wire 116 (FIGS. 12, 13). For efficient mass-production assembly, it is desirable to merely introduce the auxiliary electrode into the respective free end of the tube and form an ordinary press or pinch seal at the end, with the auxiliary electrode pinch or press seal therethrough. In a particularly simple arrangement, the legs of one of the units, for example the unit 3, are made on an automatic machine in which the two end pinch seals 8, 9 are formed as the respective electrodes 11, with the filament 115 and an electrode carrier 120 (FIG. 10) or mount similar to the electrode 11 but having the free wire ends 116*a*, 116*b*, and without the filament, and pinch-sealed in the end. This permits fully automated assembly, in which the supply of the respective filament-carrying electrodes 11 and the nonfilament-carrying electrode mounts 120 can be identical except for the presence of the filament, where desired. Only the mounts for the first pinch seal of the first leg of the composite lamp unit and the last pinch seal of the last composite lamp unit—with respect to the finished overall discharge vessel—carries a respective filament 114, 115 (FIG. 13). Thereafter, one of the wires of the mount 120, and which then will be located, with respect to the discharge vessel, between the "hot" and the "neutral" wire carrying electrodes, are connected through the respective impedance, in the simplest form a resistor, with the "hot" electrode, to then form an auxiliary operative electrode.

The lamp can be ignited by high-frequency alternating voltage, if the respective accessory apparatus EVG or EVG' is of the electronic accessory type; alternatively, abruptly rising steep firing pulses can be provided from a conventional ballast apparatus. In either case, the impedance element 117, or Z, or Z1, Z2, may be resistors or capacitors, of such value that the operating characteristics are not substantially impaired while, still, obtaining a reduction in ignition voltage.

Evacuation of the respective U-shaped units 2, 3 can be carried out through an exhaust tube of standard construction. Where this exhaust tube is located depends on the type of production machinery; for operation of the lamp, it does not matter if the pinch seal which has the auxiliary electrode carries an exhaust tube, or if the exhaust tube is placed elsewhere. For most efficient firing, it is desirable to place the auxiliary electrode 116 as close to the "cold" electrode as possible, that is, that one of the filament-carrying electrodes which is not connected by the impedance 117, Z, Z1, Z2 to the auxiliary electrode. This reduces the length of the discharge path for first, or initial firing.

The auxiliary or accessory units EVG or EVG' can be constructed in accordance with any well known system, see U.S. Pat. No. 4,647,817, Fahnrich et al, assigned to the assignee of the present application, the disclosure of which is hereby incorporated by reference; for lower voltage operation, an accessory apparatus such as described in U.S. application Ser. No. 048,005, filed May 8, 1987, Statnic et al, and assigned to the assignee of the present application, the disclosure of which is hereby incorporated by reference, is suitable.

Various changes and modifications may be made, and features described in connection with any one of the embodiments may be used with any of the others, within the scope of the inventive concept. A vestigial tipped-off exhaust tube is shown in FIG. 10 at 121.

We claim:

1. Multi-tube compact low-pressure discharge fluorescent lamp having a tubular glass discharge vessel (1) defining a continuous electrical discharge path, said tubular glass discharge vessel having a fluorescent coating applied to the inside of at least a major portion of the discharge vessel, a fill of mercury and at least one noble gas within the discharge vessel, and two filament-carrying electrodes (10, 11; E1, E2) sealed into end portions of the tubular discharge vessel, wherein the discharge vessel comprises a multi-unit sealed structure which includes at least two discharge units (2, 3; 14, 15 16; 21, 22, 23; 27, 28, 29), each of which includes a unitary U-shaped glass tube having two longitudinal leg portions (*2a, 2b*; *3a, 3b*) extending parallel to each other, an integral cross-connecting portion (4, 5), and corner bend portions connecting the leg portions at the base of the U to the cross connecting portions, wherein said corner bend portions define cold spots controlling the operating pressure of the fill of the discharge vessel, and the leg portions of the U-shaped tube remote from said connections form free ends;

a pinch or press seal (6, 7, 8, 9) sealing each of said free end portions;

wherein said at least two discharge units are positioned relative to each other with the longitudinal leg portions extending parallel to each other;

one filament-carrying electrode is sealed into one of the pinch or press seals at one free end of one leg portion of one U-shaped tube of one discharge unit, and another filament-carrying electrode is sealed into another one of the pinch or press seals of a free end of one leg portion of another U-shaped tube of another discharge unit; and wherein communicating means (12, 13) are provided forming an air-tight communicating connection between adjacent discharge units, and shaped differently from said cross connecting portions (4, 5) to form said continuous discharge path, located closely adjacent the pinch or press seals of adjacent leg portions of the U-shaped tubes of the respective units which do not have filament-carrying electrodes sealed therein, and extending laterally between said adjacent legs, said communicating connection interconnecting the adjacent discharge units into a single unitary sealed structure forming the discharge vessel and defining the continuous discharge path entirely within said discharge units of said tubular glass discharge vessel.

2. The lamp of claim 1, wherein two discharge units (2, 3) are provided, and positioned relative to each other such that the longitudinal leg portions (*2a, 2b*; *3a, 3b*) of the U-shaped tubes of the units are located in parallel planes, and a theoretical envelope surrounding the longitudinal leg portions defines a prism of essentially square cross section;

and said communicating means (12, 13) for forming a communicating connection is a single cross connection between the two adjacent leg portions of said U-shaped tubes of the discharge units which do not have filament-carrying electrodes sealed therein.

3. The lamp of claim 1, wherein at least three discharge units (21, 22, 23) are provided, and the respective discharge units are positioned relative to each other such that the longitudinal leg portions of the respective units are all located in a common plane.

4. The lamp of claim 1, wherein the discharge units (2, 3; 14, 15, 16) are positioned relative to each other such that the longitudinal leg portions (*2a, 2b*; *3a, 3b*) of the respective U-shaped tubes are located in parallel planes.

5. The lamp of claim 1, wherein more than two discharge units (27, 28, 29) are provided, located in ring form adjacent each other, and positioned relative to each other such that a theoretical envelope surrounding the longitudinal leg portions of the respective U-shaped tubes of the discharge units is of substantially prismatic shape with polygonal cross section.

6. The lamp of claim 1, wherein three discharge units (27, 28, 29) are provided, located adjacent each other such that a theoretical envelope surrounding the longitudinal leg portions of the respective units is of substantially prismatic shape with approximately triangular cross section.

7. The lamp of claim 1, wherein said cross connection comprises a glass melt connection formed by glass material of the respectively adjacent leg portions of the U-shaped glass tubes being joined together.

8. The lamp of claim 2, wherein said cross connection comprises a glass melt connection formed by glass material of the respectively adjacent leg portions of the U-shaped glass tubes being joined together.

9. The lamp of claim 1, further including an auxiliary electrode (116; ZH; ZH1, ZH2) pinch or press-sealed in one (8) of said pinch or press seals (6, 8) which do not have filament-carrying electrodes (10, 11, E1, E2) sealed therein;

and impedance means (117, Z, Z1, Z2) connecting said auxiliary electrode (116; ZH; ZH1, ZH2) with one of said filament-carrying electrodes (10, 11, E1, E2).

10. The lamp of claim 9, wherein the auxiliary electrode comprises a wire element (116).

11. The lamp of claim 9, wherein the auxiliary electrode comprises a two-conductor (116*a*, 116*b*) filamentless lamp mount identical to said filament-carrying electrodes without a filament.

12. The lamp of claim 9, wherein said impedance means (117, Z, Z1, Z2) comprises a resistor.

13. The lamp of claim 9, wherein said impedance means (117, Z, Z1, Z2) comprises a capacitor.

14. The lamp of claim 9, wherein said impedance means has an impedance value dimensioned to negligibly affect the operating characteristics of the lamp, when connected to a source of electrical energy, while transferring an initial firing voltage to a position within the discharge path intermediate of said filament-carrying electrodes.

15. The lamp of claim 9, in combination with a lamp starting and operating characteristics controlling auxiliary circuit element (EVG, EVG'), said auxiliary circuit element being adapted to be connected to a source of network alternating voltage, and being connected to the filament-carrying electrodes, and defining supply to a "hot" filament-carrying electrode and a "ground or neutral or reference" electrode supply;

and wherein said auxiliary electrode (116; ZH) is connected through said impedance means (117, Z) to the "hot" electrode supply.

16. the lamp of claim 2, further including an auxiliary electrode (116; ZH) pinch or press-sealed in one (8) of said pinch or press seals (6, 8) which do not have filament-carrying electrodes (10, 11, E1, E2) sealed therein;

impedance means (117, Z) connecting said auxiliary electrode with one of said filament-carrying electrodes (10, 11, E1, E2);

wherein said impedance means has an impedance value dimensioned to negligibly affect the operating characteristics of the lamp, when connected to a source of electrical energy, while transferring an initial firing voltage to a position within the discharge path intermediate of said filament-carrying electrodes;

in combination with a lamp and starting and operating characteristics controlling auxiliary circuit element (EVG, EVG'), said auxiliary circuit element being adapted to be connected to a source of network alternating voltage, and being connected to the filament-carrying electrodes, and defining supply to a "hot" filament-carrying electrode and a "ground or neutral or reference" electrode supply;

and wherein said auxiliary electrode (116; ZH) is connected through said impedance means (117, Z) to the "hot" electrode supply.

17. Multi-tube compact low-pressure discharge fluorescent lamp having a closed tubular glass discharge vessel (1) defining a continuous closed electrical discharge path, said tubular glass discharge vessel having a fluorescent coating applied to the inside of at least a major portion of the discharge vessel and a fill of mercury and at least one noble gas within the closed discharge vessel, wherein the discharge vessel comprises a two-unit closed and sealed structure which includes two discharge units (2, 3), each of which comprises a pair of elongated essentially parallel leg portions (2*a*, 2*b*, 3*a*, 3*b*), cross-connecting means (4, 5) located adjacent one end portion of the leg portions of the pairs to connect said leg portions together and closing seals (6, 8) sealing the other end portions of said leg portions;

a filament-carrying electrode (10, 11; E1, E2) located in one leg portion (2*a*, 3*a*) of each one of said units, and sealed therein through a respective closing seal (6);

communicating means (12, 13) located adjacent the other end portions of the other ones of the leg portions (2*b*, 3*b*) of said units, and forming an airtight communicating connection between adjacent discharge units to form said continuous closed discharge path; and an auxiliary electrode (116; ZH) sealed into said other end portion of one of said other leg portions (2*b*, 3*b*) to place said auxiliary electrode (116; ZH) within said continuous closed discharge path intermediate of said filament-carrying electrodes (10, 11; E1, E2).

18. The lamp of claim 17, wherein said auxiliary electrode comprises wire means (116, 116*a*, 116*b*).

19. The lamp of claim 17 wherein the closing seals (6, 8) of all said leg portions (2*a*, 2*b*, 3*a*, 3*b*) remote from said cross connecting means (4, 5) are pinch or press seals (6, 7, 8, 9).

20. The lamp of claim 17, wherein the auxiliary electrode comprises a two-conductor (116*a*, 116*b*) filamentless lamp mount identical to said filament-carrying electrodes but without a filament.

21. The lamp of claim 17, further including impedance means (117, Z) connecting said auxiliary electrode (116, ZH) to one of said filament-carrying electrodes (10, 11; E1, E2).

22. The lamp of claim 21 wherein said impedance means comprises a resistor.

23. The lamp of claim 21, wherein said impedance means has an impedance value dimensioned to negligibly affect the operating characteristics of the lamp, when connected to a source of electrical energy, while transferring an initial firing voltage to a position within the discharge path intermediate of said filament-carrying electrodes.

24. The lamp of claim 21, in combination with a lamp starting and operating characteristics controlling auxiliary circuit element (EVG, EVG'), said auxiliary circuit element being adapted to be connected to a source of network alternating voltage, and being connected to the filament-carrying electrodes, and defining supply to a "hot" filament-carrying electrode and a "ground or neutral or reference " electrode supply;

and wherein said auxiliary electrode (116; ZH) is connected through said impedance means (117, Z) to the "hot" electrode supply.

25. Multi-tube compact low-pressure discharge fluorescent lamp having a closed tubular glass discharge vessel (1) defining a continuous closed electrical discharge path, said tubular glass discharge vessel having a fluorescent coating applied to the inside of at least a major portion of the discharge vessel and a fill of mercury and at least one noble gas within the closed discharge vessel, wherein the discharge vessel comprises a multi-unit closed and sealed structure which includes two discharge units (2, 3), each of which comprises a pair of elongated essentially parallel leg portions (2*a*, 2*b*, 3*a*, 3*b*), cross-connecting means (4, 5) located adjacent end portions of the leg portions of the pairs to connect said leg portions together and closing seals (6, 8) sealing the other end portions of said leg portions;

a filament-carrying electrode (10, 11; E1, E2) located in one leg portion (*a*, 3*a*) of two of said units, and sealed therein through a respective closing seal (6);

communicating means (12, 13) located adjacent the other end portions of the other ones of the leg portions (2*b*, 3*b*) of said units, and forming an air-tight communicating connection between adjacent discharge units to form a continuous discharge path;

at least one auxiliary electrode (116; ZH; ZH1; ZH2) sealed into said other end portion of at least one leg portion (3*a*) which is free from a filament-carrying electrode in at least one of said units; and impedance means (117; Z, Z1, Z2) connecting said at least one auxiliary electrode to one of said filament-carrying electrodes (10, 11; E1, E2).

26. The lamp of claim 25 wherein all the closing seals (6, 8) sealing the ends of all said leg portions (2*a*, 2*b*, 3*a*, 3*b*) remote from said cross connecting means (4, 5) are sealed by a pinch or press seal (6, 7, 8, 9).

* * * * *